US010104489B2

(12) United States Patent
Arnold et al.

(10) Patent No.: US 10,104,489 B2
(45) Date of Patent: Oct. 16, 2018

(54) METHOD FOR USING A MOBILE DEVICE EQUIPPED WITH AT LEAST TWO MICROPHONES FOR DETERMINING THE DIRECTION OF LOUDSPEAKERS IN A SETUP OF A SURROUND SOUND SYSTEM

(71) Applicant: THOMSON LICENSING, Issy les Moulineaux (FR)

(72) Inventors: Michael Arnold, Isernhagen (DE); Michael Drexler, Gehrden (DE); Florian Keiler, Hannover (DE)

(73) Assignee: Thomson Licensing, Issy les Moulineau (FR)

( * ) Notice: Subject to any disclaimer, the term of this patent is extended or adjusted under 35 U.S.C. 154(b) by 0 days.

(21) Appl. No.: 15/379,633

(22) Filed: Dec. 15, 2016

(65) Prior Publication Data

US 2017/0180904 A1 Jun. 22, 2017

(30) Foreign Application Priority Data

Dec. 18, 2015 (EP) ..... 15307064

(51) Int. Cl.

| | |
|---|---|
| ***H04R 5/02*** | (2006.01) |
| ***H04S 7/00*** | (2006.01) |
| ***H04R 1/40*** | (2006.01) |
| ***H04R 5/04*** | (2006.01) |
| ***H04R 29/00*** | (2006.01) |

(52) U.S. Cl.

CPC ..... *H04S 7/301* (2013.01); *H04R 1/406* (2013.01); *H04R 5/02* (2013.01); *H04R 5/04* (2013.01); *H04R 29/002* (2013.01); *H04R 2205/024* (2013.01); *H04R 2499/11* (2013.01)

(58) Field of Classification Search

CPC ..... H04R 1/406; H04R 2205/024; H04R 2499/11; H04R 29/002; H04R 5/02; H04R 5/04; H04S 7/301

USPC ..... 381/56, 58, 59, 77, 122, 300, 303, 304, 381/307

See application file for complete search history.

(56) References Cited

U.S. PATENT DOCUMENTS

| | | | | |
|---|---|---|---|---|
| 2006/0088174 | A1 | 4/2006 | Deleeuw et al. | |
| 2012/0075957 | A1 | 3/2012 | De Bruijn | |
| 2014/0169569 | A1* | 6/2014 | Toivanen | H04R 5/04 381/17 |
| 2014/0270282 | A1* | 9/2014 | Tammi | H04R 5/02 381/300 |
| 2016/0037282 | A1* | 2/2016 | Giron | H04S 7/30 381/303 |

(Continued)

FOREIGN PATENT DOCUMENTS

| | | |
|---|---|---|
| EP | 1522868 | 4/2005 |
| EP | 2899997 | 7/2015 |

*Primary Examiner* — Vivian Chen
*Assistant Examiner* — Friedrich W Fahnert
(74) *Attorney, Agent, or Firm* — Vincent E. Duffy

(57) ABSTRACT

A smartphone having two microphones is used for determining the direction of a loudspeaker in a surround system setup. This is performed using smartphone rotation in azimuth and polar angle direction while capturing in its microphones a test signal from a current one of the loudspeakers. From the microphone signals a corresponding TDOA value is calculated, and the smartphone is rotated until that TDOA value is nearly zero, resulting in a loudspeaker direction information.

17 Claims, 7 Drawing Sheets

(56) References Cited

U.S. PATENT DOCUMENTS

| | | | | |
|---|---|---|---|---|
| 2016/0198282 | A1* | 7/2016 | Kim | G06F 3/165<br>381/303 |
| 2016/0309258 | A1* | 10/2016 | Hiscock | H04R 5/04 |
| 2016/0309277 | A1* | 10/2016 | Hiscock | H04S 7/301 |

* cited by examiner

METHOD FOR USING A MOBILE DEVICE EQUIPPED WITH AT LEAST TWO MICROPHONES FOR DETERMINING THE DIRECTION OF LOUDSPEAKERS IN A SETUP OF A SURROUND SOUND SYSTEM

REFERENCE TO RELATED EUROPEAN APPLICATION

This application claims priority from European No. 15307064.4, entitled "Method For Using A Mobile Device Equipped With At Least Two Microphones for Determining The Direction Of Loudspeakers In A Setup Of A Surround Sound System," filed on Dec. 18, 2015, the contents of which are hereby incorporated by reference in its entirety.

TECHNICAL FIELD

The invention relates to a method for using a mobile device equipped with at least two microphones for determining the direction of loudspeakers $l_k$ in a setup of a surround sound system including N loudspeakers, k=1 . . . N.

BACKGROUND

For 3D sound reproduction more and more loudspeakers are required for rendering additional audio channels that surround the listener. To ensure the best listener experience, this implicitly requires the correct determination of the direction as part of the position information of each loudspeaker, in order to accurately calibrate the array of speakers and to ensure a correct rendering process.

Currently different methods are available for determination of the direction of arrival, requiring the use of a multi-microphone device. This results in additional costs at user side.

SUMMARY OF INVENTION

Today the number of smartphones equipped with more than one microphone (two or three) is increasing. A smartphone having at least two microphones is used for determining the direction of a loudspeaker in a surround system setup. The resulting effect is calibration equipment for home theatre setup that is today available in most households.

The advantages of using such mobile devices are:

cheap solution;

an improvement of the calibration setup can be achieved by updating an app;

by using more mobile devices including microphones, the measurement precision can be increased and the calibration time can be minimised.

A problem to be solved by the invention is to provide a cheap measurement of loudspeaker positions in a surround sound setup. This problem is solved by the method disclosed in claim 1 or in claim 2.

Advantageous additional embodiments of the invention are disclosed in the respective dependent claims.

In principle, the inventive method is adapted for using a mobile device equipped with at least two microphones for determining the direction of loudspeakers $l_k$ in a setup of a surround sound system including N loudspeakers, k=1 . . . N, wherein said direction is expressed by an azimuth angle $\phi_k$ and a polar angle $\theta_k$, said method including:

a) setting initial values for said azimuth angle $\phi_k$ and said polar angle $\theta_k$ for loudspeaker $l_k$ direction;

b) in a first loop over mobile device position angle $\alpha$ for the determination of one of $\phi_k$ and $\theta_k$, and thereafter in a second loop over mobile device position angle $\alpha$ for the determination of the other one of $\phi_k$ and $\theta_k$:

c) setting k=1;

d) in a sub-loop over k:

e) in a sub-sub-loop over a rotation angle of said mobile device:

f) causing loudspeaker $l_k$ to emit a test signal;

g) rotating said mobile device and providing for said mobile device a corresponding measured mobile device rotation angle value $\alpha_k$;

h) capturing corresponding mobile device microphone signals from said loudspeaker $l_k$ test signal;

i) calculating from said microphone signals a corresponding TDOA value;

j) if said TDOA value is not zero or is not smaller than a predetermined threshold value, returning to step f);

k) otherwise, calculating a corresponding azimuth $\phi_k$ or polar $\theta_k$, respectively, angle value for the position of loudspeaker $l_k$;

l) incrementing k by '1';

m) if k≤N, returning to step f);

n) otherwise, checking whether both of $\phi_k$ and $\theta_k$ have been determined, and if not true, returning to step b);

o) after all positions of said N loudspeakers have been determined, providing a corresponding set of N pairs of azimuth and polar angle values $\phi_k$ and $\theta_k$ for said loudspeakers $l_k$ and for all k.

or for using a mobile device equipped with at least two microphones, having a known distance from each other, for determining the direction of loudspeakers $l_k$ in a setup of a surround sound system including N loudspeakers, k=1 . . . N, wherein said direction is expressed by an azimuth angle $\phi_k$ and a polar angle $\theta_k$, said method including:

a) setting initial values for said azimuth angle $\phi_k$ and said polar angle $\theta_k$ for loudspeaker $l_k$ direction;

b) in a first loop over mobile device position angle $\alpha$ for the determination of one of $\phi_k$ and $\theta_k$, and thereafter in a second loop over mobile device position angle $\alpha$ for the determination of the other one of $\phi_k$ and $\theta_k$:

c) positioning said mobile device at a desired azimuth angle or polar angle;

d) setting k=1;

e) in a sub-loop over k:

f) causing loudspeaker $l_k$ to emit a test signal;

g) capturing the mobile device microphone signals from said loudspeaker $l_k$ test signal;

h) determining from said captured mobile device microphone signals a loudspeaker distance difference value and calculating a corresponding mobile device position angle value;

i) calculating a corresponding azimuth $\phi_k$ or polar $\theta_k$, respectively, angle value for the position of loudspeaker $l_k$;

j) incrementing k by '1';

k) if k≤N, returning to step f);

l) otherwise, checking whether both of $\phi_k$ and $\theta_k$ have been determined, and if not true, returning to step b);

m) after all positions of said N loudspeakers have been determined, providing a corresponding set of N pairs of azimuth and polar angle values $\phi_k$ and $\theta_k$ for said loudspeakers $l_k$ and for all k.

The disclosure further pertains first to a measurement device for determining the direction of loudspeakers $l_k$ in a setup of a surround sound system including N loudspeakers, k=1 . . . N, adapted to cooperate with a mobile device equipped with at least two microphones, wherein that direction is expressed by an azimuth angle $\phi_k$ and a polar angle $\theta_k$. The mobile device comprises at least one processor configured for:

a) setting initial values for the azimuth angle $\phi_k$ and the polar angle $\theta_k$ for loudspeaker $l_k$ direction;
b) in a first loop over mobile device position angle $\alpha$ for the determination of one of $\phi_k$ and $\theta_k$, and thereafter in a second loop over mobile device position angle $\alpha$ for the determination of the other one of $\phi_k$ and $\theta_k$:
c) setting k=1;
d) in a sub-loop over k:
e) in a sub-sub-loop over a rotation angle of the mobile device:
f) receiving for the mobile device being rotated a corresponding measured mobile device rotation angle value $\alpha_k$;
g) receiving corresponding mobile device microphone signals from emitted loudspeaker $l_k$ test signal;
h) calculating from the microphone signals a corresponding TDOA value;
i) if the TDOA value is not zero or is not smaller than a predetermined threshold value, returning to step f);
j) otherwise, calculating a corresponding azimuth $\phi_k$ or polar $\theta_k$, respectively, angle value for the position of loudspeaker $l_k$;
k) incrementing k by '1';
l) if $k \leq N$, returning to step f);
m) otherwise, checking whether both of $\phi_k$ and $\theta_k$ have been determined, and if not true, returning to step b);
n) after all positions of the N loudspeakers have been determined, providing a corresponding set of N pairs of azimuth and polar angle values $\phi_k$ and $\theta_k$ for the loudspeakers $l_k$ and for all k.

In addition, the disclosure pertains secondly to a measurement device for determining ing the direction of loudspeakers $l_k$ in a setup of a surround sound system including ing N loudspeakers, k=1 . . . N, adapted to cooperate with a mobile device equipped with at least two microphones, wherein that direction is expressed by an azimuth angle $\phi_k$ and a polar angle $\theta_k$. The mobile device comprises at least one processor configured for:

a) setting initial values for the azimuth angle $\phi_k$ and the polar angle $\theta_k$ for loudspeaker $l_k$ direction;
b) in a first loop over mobile device position angle $\alpha$ for the determination of one of $\phi_k$ and $\theta_k$, and thereafter in a second loop over mobile device position angle $\alpha$ for the determination of the other one of $\phi_k$ and $\theta_k$, the mobile device having a desired azimuth angle or polar angle:
c) setting k=1;
d) in a sub-loop over k:
e) receiving mobile device microphone signals from emitted loudspeaker $l_k$ test signal;
f) determining from said captured mobile device microphone signals a loudspeaker distance difference value and calculating a corresponding mobile device position angle value;
g) calculating a corresponding azimuth $\phi_k$ or polar $\theta_k$, respectively, angle value for the position of loudspeaker $l_k$;
h) incrementing k by '1';
i) if $k \leq N$, returning to step e);
j) otherwise, checking whether both of $\phi_k$ and $\theta_k$ have been determined, and if not true, returning to step b);
k) after all positions of the N loudspeakers have been determined, providing a corresponding set of N pairs of azimuth and polar angle values $\phi_k$ and $\theta_k$ for the loudspeakers $l_k$ and for all k.

Advantageously, the at least one processor is further configured for:

a) capturing mobile device microphone signals from loudspeaker $l_k$ test signal emitted by a selected loudspeaker $l_k$ among the N loudspeakers;
b) receiving for the mobile device a measured mobile device rotation angle value $\alpha_k$ corresponding to a rotation of the mobile device;
c) calculating a corresponding TDOA value;
d) if said TDOA value is not zero or is not smaller than a predetermined threshold value, returning to step a);
e) otherwise, defining an initial direction angle value $\beta=0$;
f) receiving for the mobile device a measured rotation angle value $\beta$ corresponding to rotating the mobile device by an angle $\beta \approx \pi/4$;
g) receiving mobile device microphone signals from emitted loudspeaker $l_k$ test signal;
h) calculating from the mobile device microphone signals a loudspeaker distance difference value $\Delta_k$ and a microphone distance value $$d_{12} = \frac{\Delta_k}{\sin\beta}.$$

BRIEF DESCRIPTION OF DRAWINGS

Exemplary embodiments of the invention are described with reference to the accompanying drawings, which show in.

Figure 5:
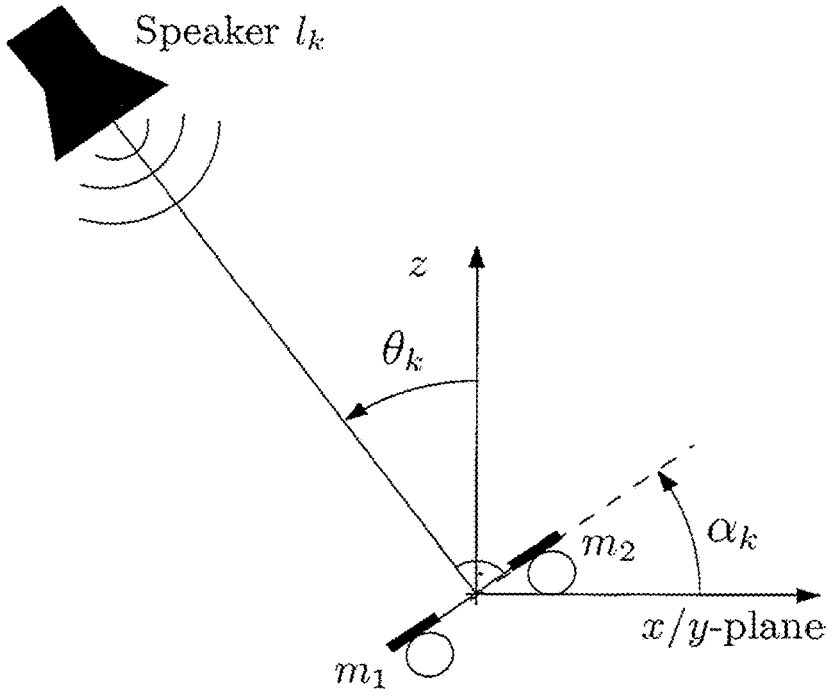
Figure 6:
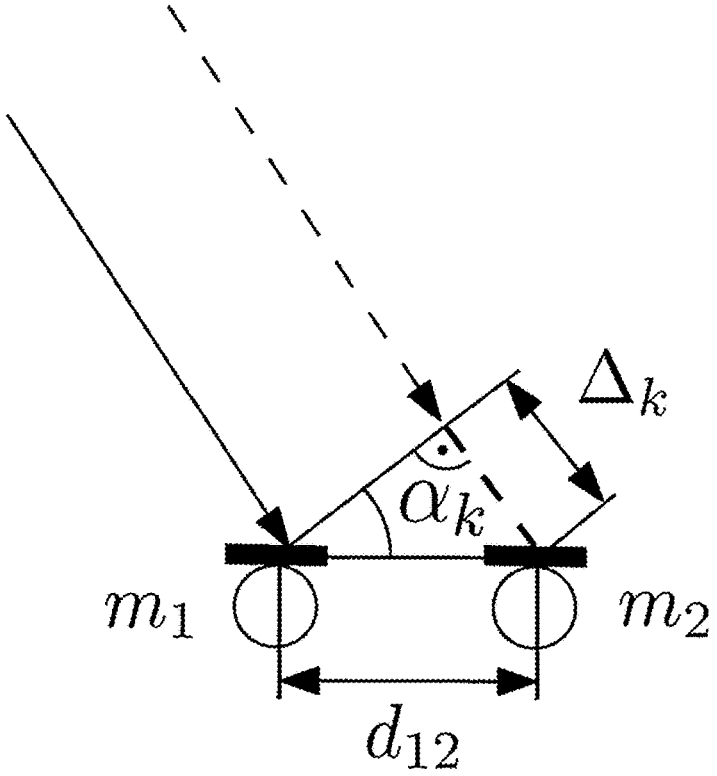
Figure 7:
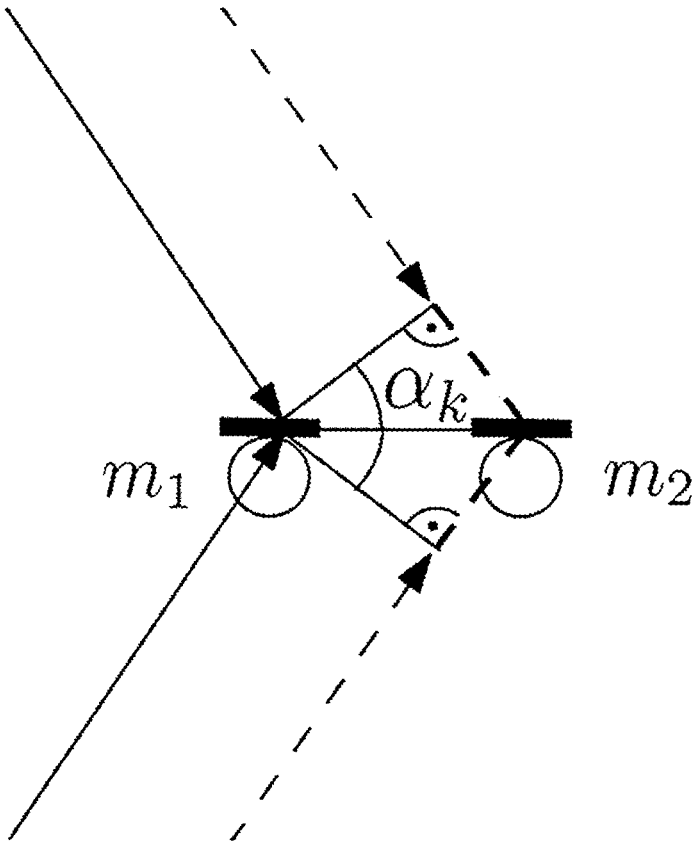
Figure 8:
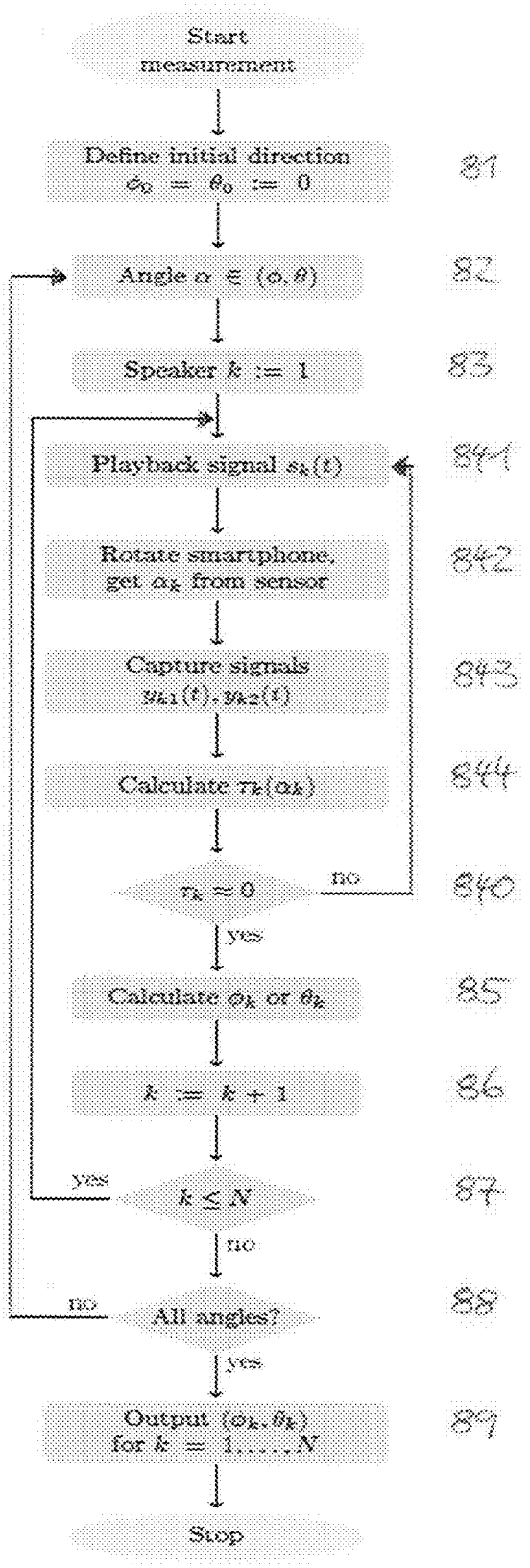
Figure 9:
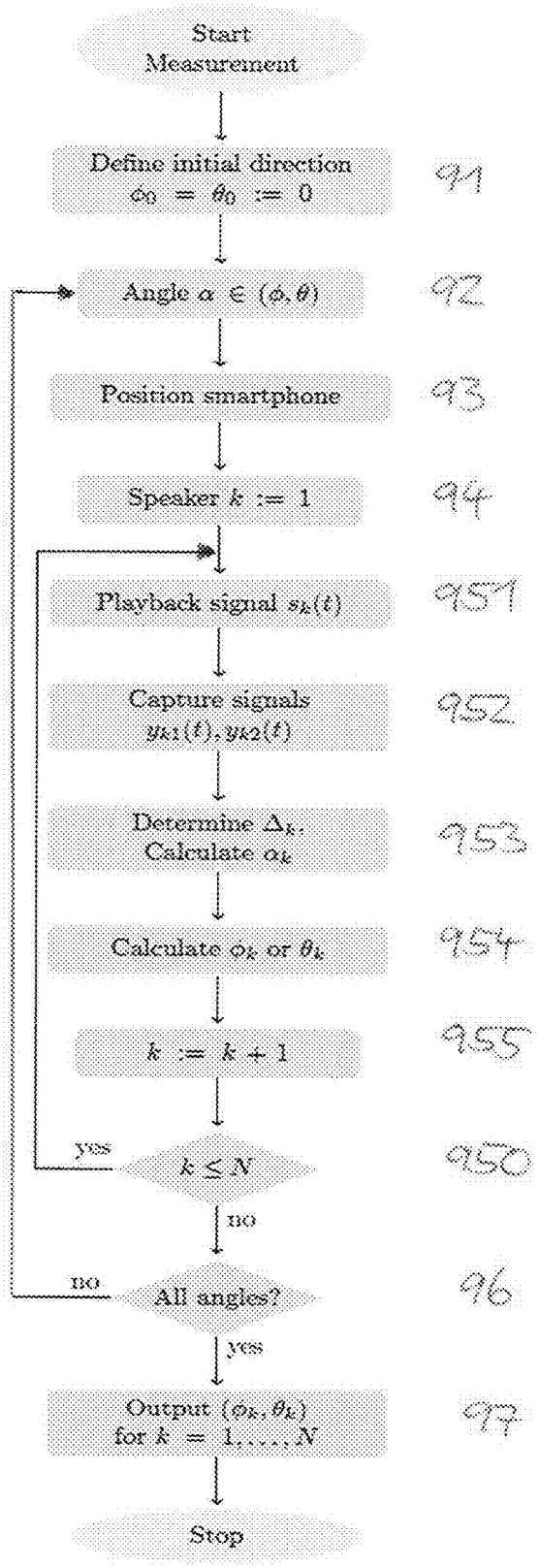
Figure 10:
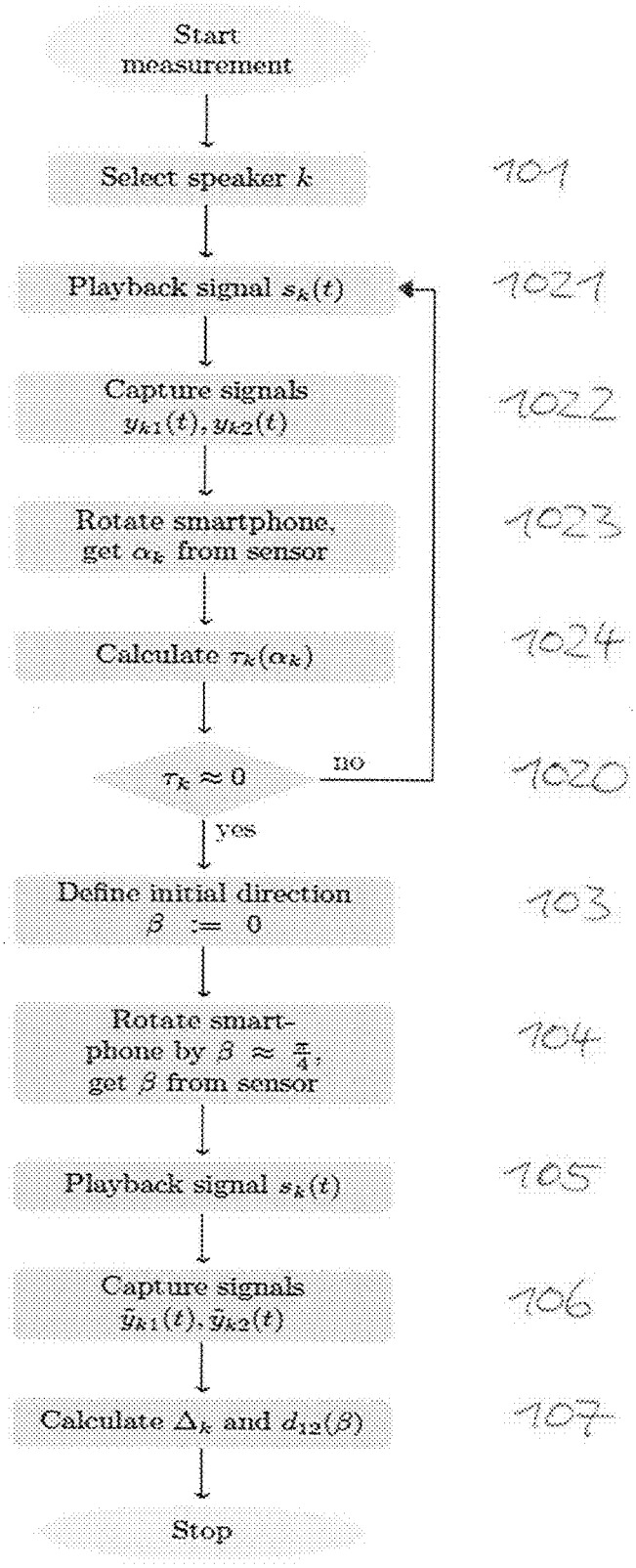

measured x/y-plane;

FIG. 5 rotation of microphone pair by angle $\alpha_k$ and corresponding $(\theta_k, \phi_k)$, $\theta_k=\alpha_k$ measured from the z direction;

FIG. 6 assumption of far-away loudspeaker in relation to the microphone distance;

FIG. 7 ambiguity of loudspeaker location;

FIG. 8 interactive direction measurement for $k \in 1, \ldots, N$ loudspeakers;

FIG. 9 successive direction measurement for $k \in 1, \ldots, N$ loudspeakers;

FIG. 10 microphone distance calculation process.

DESCRIPTION OF EMBODIMENTS

Even if not explicitly described, the following embodiments may be employed in any combination or sub-combination.

The correct calibration of a multi-channel audio system requires localisation of multiple speakers. This includes the determination of the direction and distance relative to the listener position. The distance can be measured as described in EP 2899997 A1 or by optical means using the camera of a smartphone. The direction angles are determined by using an acoustical measurement as described below.

Direction Angles

Figure 1:
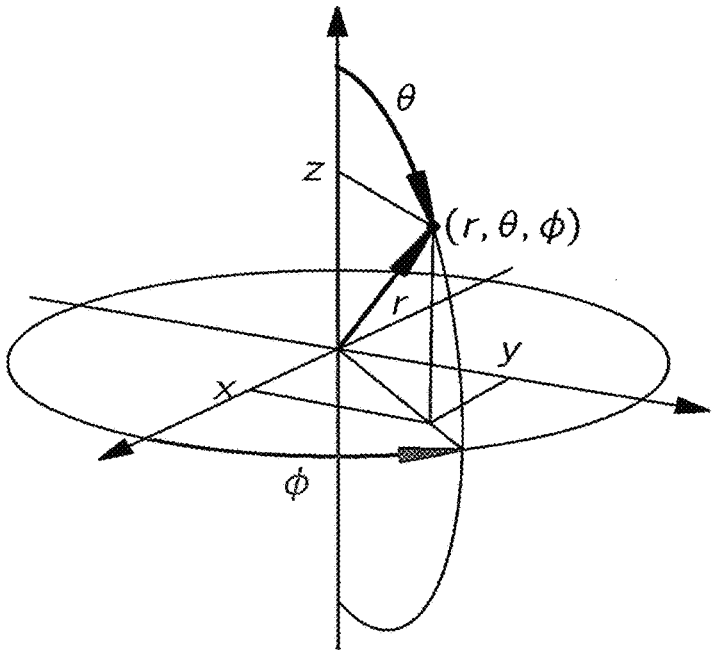
FIG. 1 spherical coordinate system.

Assuming that the listener position is located in the coordinate origin of a three-dimensional coordinate system, the direction of each loudspeaker can be described by the azimuth angle $\phi$ and the polar angle $\theta$ in spherical coordinates (r, $\theta$, $\phi$), see FIG. 1.

The angles ($\theta$, $\phi$) can be determined in an interactive way by a device carrying two microphones, or by more devices each carrying one microphone.

Sound Propagation

In the following a microphone pair ($m_1$, $m_2$) with known orientation and a speaker $l_k$ with unknown position are considered. If the speaker emits a signal $s_k(t)$, the signals captured by the microphones will be attenuated and altered by noise. The so-called Time of Flight (ToF) $\Delta T_{k1}$ is the time the sound wave needs for propagating from the source (speaker $l_k$) to the microphone $m_1$. Using a second microphone $m_2$ the ToF is $\Delta T_{k2}$. The signals at the microphone positions are:

$$y_{k1}(t)=g(d_{k1})s_k(t-\Delta T_{k1})+n_1(t)$$

$$y_{k2}(t)=g(d_{k2})s_k(t-\Delta T_{k2})+n_2(t)$$

The function $g(d_k\circ)$ is an attenuation factor, which describes the dependence of the amplitude on the distance between loudspeaker k and microphone 1 or 2 denoted by $d_k\circ$. The amplitudes and the phases of the two signals $y_{k1}(t)$, $y_{k2}(t)$ differ due to the relative positioning of the microphones to the source. The additive terms $n_1(t)$ and $n_2(t)$ take into account environmental and internal (thermal) noise of the microphones.

Angle Determination

Figure 2:
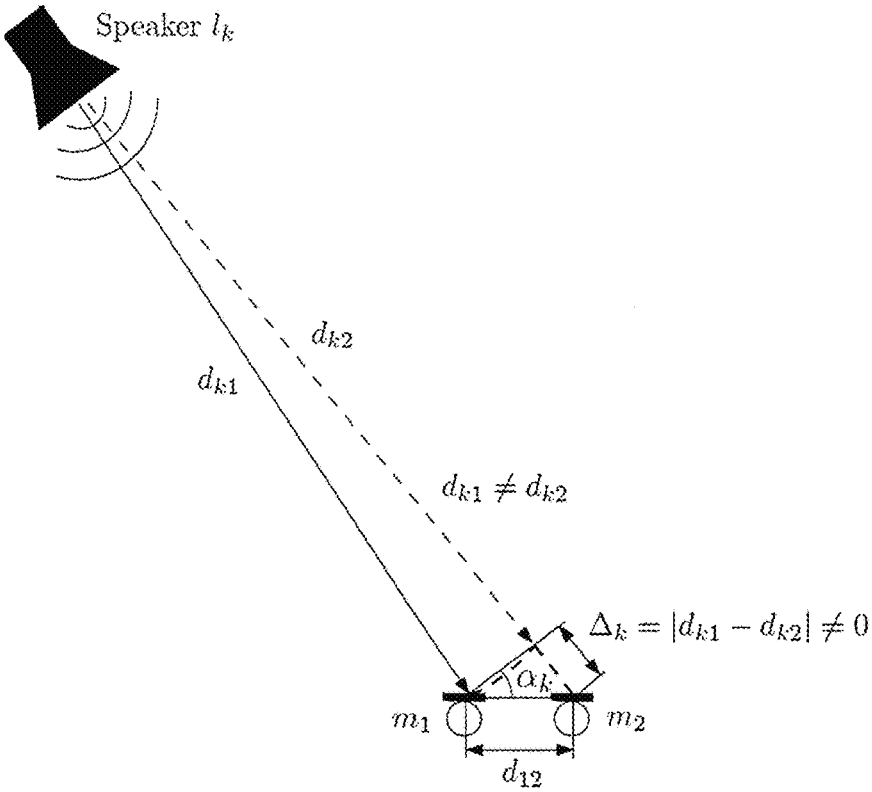
FIG. 2 different time of flight (ToF) for two microphones.

The angle measurements can be integrated in a calibration step of a 3D surround sound loudspeaker setup controlled by a smartphone. The determination of the angles are based on the measurement of the Time Difference of Arrival TDOA. The TDOA for loudspeaker $l_k$ for the microphone pair (1,2) is defined as $\tau_k=\Delta T_{k1}-\Delta T_{k2}$. This corresponds to the spatial difference $\Delta_k=|d_{k1}-d_{k2}|=C|\tau_k|$ between the two microphones and the loudspeaker with the sound velocity in air as the scaling factor, see FIG. 2. c is the speed of sound waves in the air.

TDOA Measurement

It is known to estimate the TDOA by using a cross-correlation (CC) function $$R_k(\tau)=\mathbb{E}\{y_{k1}(t)y_{k2}(t-\tau)\}=\int_{-\infty}^{+\infty}Y_{k1}(f)Y^*_{k2}(f)\exp^{2\pi ifx}df$$

with $y_{k(1|2)}(t)$ being the signals captured by the microphones ($m_1$ or $m_2$ for speaker k) and $Y_{k(1|2)}(f)$ being their respective Fourier transforms. The time delay between the captured signals is obtained by searching the peak in the correlation $$\tau_k = \underset{\tau}{\operatorname{argmax}} R_k(\tau).$$

Known techniques for providing a sharper peak in the measurement and using interpolation for a higher time resolution can be applied.

Calibration Process—Interactive Angle Measurement

Figure 3:
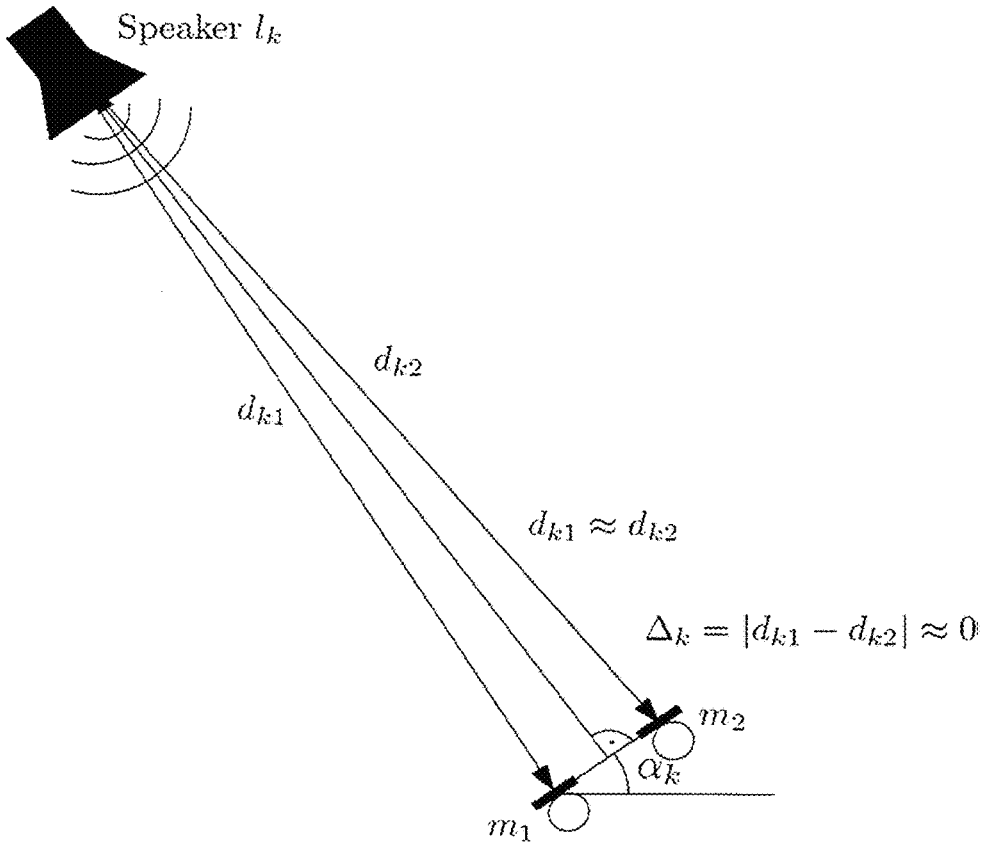
FIG. 3 equal time of flight after re-orientation of microphone pair.

In an interactive measurement a smartphone carrying a pair of microphones is used for the direction determination. It is not necessary that the distance $d_{12}$ (see FIG. 2) between the microphone pair ($m_1$, $m_2$) is known. If the ToF needed for the sound wave to propagate from the source to the first microphone is the same as for the second microphone as is depicted in FIG. 3, the TDOA is zero.

Figure 4:
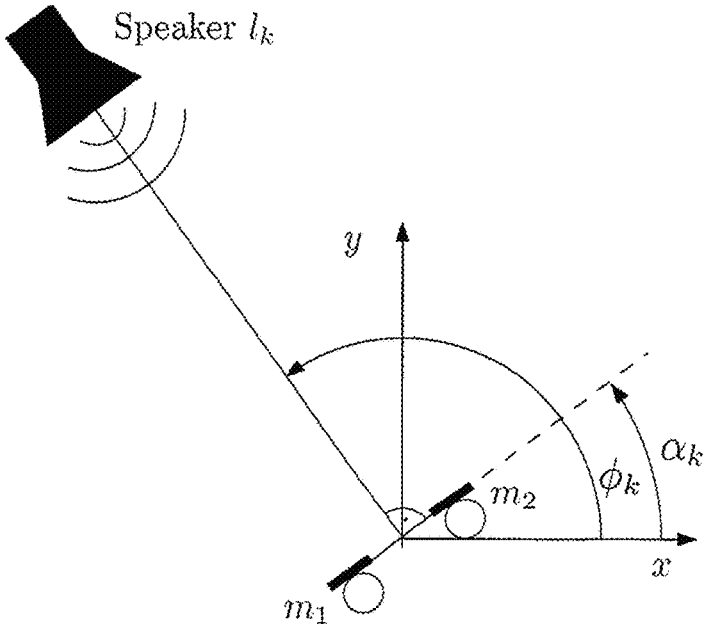
FIG. 4 rotation of microphone pair by angle $\alpha_k$ and corresponding $(\theta_k, \phi_k)$, $$\phi_k = \alpha_k + \frac{\pi}{2}$$

The angles $\phi_k$ and $\theta_k$ are defined relative to the baseline connecting the two microphones (see FIGS. 4 and 5). In a first step a reference direction is defined from which the angles are measured. For determination of the $\theta_k$ angle, the microphone pair can be placed in the x/y-plane using the z-axis as reference direction (see FIG. 5).

During playback of the signal from the loudspeaker, the user is moving the smartphone in the direction of the loudspeaker. In this case the TDOA can be continuously measured. This implies an ongoing transmission and capturing of the calibration signal. The device carried by the user can provide a graphical feedback like a level meter which increases if the TDOA is converging to zero. As an alternative, a special sound can be played back if TDOA for the microphones is converging to zero.

In an automatic setting the time delay is measured continuously and the angles yielding the minimal time delay are computed as shown in the FIG. 8 flow chart. The angle measurement is carried out by using corresponding data from the internal sensors of the smartphone.

In step 81, initial values $\phi_0$ and $\theta_0$ for the azimuth angle $\phi_k$ and the polar angle $\theta_k$ are defined, e.g. $\phi_0=\theta_0=0$. The processing is continued from step 82 to step 88 with a first loop over angle $\alpha$ for the determination of one of $\phi_k$ and $\theta_k$, e.g. $\phi_k$. Thereafter that loop over angle $\alpha$ is again carried out for the determination of the other one of $\phi_k$ and $\theta_k$, e.g. $\theta_k$. In step 89 $\phi_k$ and $\theta_k$, k=1 . . . N, for all N loudspeaker positions are output.

In step 83 k=1 is set, and within the following sub-loop over k from step 841 to step 87 k is incremented in step 86 until k>N in step 87.

In a sub-sub-loop beginning in step 841, loudspeaker $l_k$ emits a test signal $s_k(t)$. In step 842 the smartphone is rotated by a recommended angle, e.g. 45° or 90°, and the corresponding true smartphone rotation angle $\alpha_k$ is provided from the related sensors within the smartphone. Then the smartphone microphones capture signals $y_{k1}(t)$ and $y_{k2}(t)$ in step 843, and in step 844 $\tau_k(\alpha_k)$ is calculated as described above. By testing step 840 the processing is continued with step 841 for a different smartphone rotation angle, until in step 840 $\tau_k=0$ or nearly zero, i.e. until the value $\tau_k$ is smaller than a predetermined threshold value. If true, in step 85 the corresponding $\phi_k$ or $\theta_k$, respectively, value is calculated as described above.

Calibration Process—Successive Angle Measurement

In case the distance $d_{12}$ (see FIG. 2) between the microphone pair ($m_1$, $m_2$) is known, e.g. from information taken from a corresponding database, as an alternative to interactive rotation of the smartphone with respect to each loudspeaker for direction determination, another processing can be applied. It can be assumed that the distances $d_{k1}$,$d_{k2}$ between the mobile device and the loudspeakers are much greater than the distance $d_{12}$ between the microphones, i.e. $d_{k1}>>d_{12}$. In that case the right-angled triangle in FIG. 6 can be used for the direction computation of N loudspeakers according to smart phone position angle $$\alpha_k = \arcsin\left(\frac{\Delta_k}{d_{12}}\right),$$

k=1, . . . , N.

To avoid the ambiguity about in which half space a loudspeaker is located (see FIG. 7), two successive measurements can be conducted. In the second measurement the device can be rotated by 90°. In this case the determination of the sign of the time delay $\tau_k$ is sufficient for fixing the direction of the loudspeaker.

In a practical setting each measurement can be conducted for all loudspeakers before performing the next one, as depicted in the FIG. 9 flow chart.

In step 91, initial values $\phi_0$ and $\theta_0$ for the azimuth angle $\phi_k$ and the polar angle $\theta_k$ are defined, e.g. $\phi_0=\theta_0=0$. The processing is continued from step 92 to step 96 with a first loop over smart phone position angle $\alpha$ for the determination of one of $\phi_k$ and $\theta_k$, e.g. $\phi_k$. Thereafter that loop over smart phone position angle $\alpha$ is again carried out for the determination of the other one of $\phi_k$ and $\theta_k$, e.g. $\theta_k$. In step 97 $\phi_k$ and $\theta_k$, k=1 . . . N, for all N loudspeaker positions are output.

In step 93 the current position of the smartphone is determined from the internal sensors of the smartphone. In step 94 k=1 is set and, within the following sub-loop processing over k from step 951 to step 950, k is incremented in step 955 until k>N in step 950.

In step 951 loudspeaker $l_k$ emits a test signal $s_k(t)$. In step 952 the smartphone microphones are capturing signals $y_{k1}(t)$ and $y_{k2}(t)$. Also using $d_{12}$, in step 953 the loudspeaker distance difference value $\Delta_k$ and a corresponding smart phone position angle value $\alpha_k$ are calculated therefrom as described above, and in step 954 the corresponding $\phi_k$ or $\theta_k$, respectively, value is calculated as described above.

Calibration Process—Determination of Microphone Distance

In order to conduct a successive measurement as described in the preceding section, a necessary precondition is knowledge of the smartphone microphone distance $d_{12}$. In case this distance is not known in advance it can be determined by an interactive measurement using one loudspeaker k. During the interactive measurement processing described in connection with FIG. 10, the smartphone is aligned in the direction of the loudspeaker as described in section Interactive angle measurement.

Starting from this reference position, the smartphone is rotated by a predefined angle $$\beta < \frac{\pi}{2}.$$

In this position the loudspeaker distance difference $\Delta_k$ is measured and the microphone distance $d_{12}$ is calculated by $$d_{12} = \frac{\Delta_k}{\sin\beta},$$

cf. FIG. 6 and FIG. 10.

Microphone distance $d_{12}$ is then used in the direction determination of the remaining loudspeakers as described in section Successive angle measurement.

In FIG. 10 the calculation process for the microphone distance starts with selecting loudspeaker $l_k$ in step 101. In step 1021 that loudspeaker emits a test or playback signal $s_k(t)$ and the smartphone is rotated slowly and captures in step 1022 the signals $y_{k1}(t)$ and $y_{k2}(t)$. In step 1023 the current value of $\tau_k(\alpha_k)$ is calculated and in step 1020 it is checked whether the current value of $\tau_k$ is zero or nearly zero, i.e. is smaller than a predetermined threshold value. If not true, the processing continues with step 1021. If true, the smartphone has reached a desired reference position and the processing moves to step 103 in which an initial direction angle value $\beta=0$ is set. In step 104 the smartphone is rotated by $\beta\approx\pi/4$ and the corresponding true rotation angle $\beta$ is provided from the related sensors within the smartphone.

In step 105 loudspeaker $l_k$ again emits the test or playback signal $s_k(t)$. In step 106 the signals $y_{k1}(t)$ and $y_{k2}(t)$ are captured, and in step 107 the loudspeaker distance difference value $\Delta_k$ and the microphone distance value $d_{12}(\beta)$ are calculated.

The described processing can be carried out by a single processor or electronic circuit, or by several processors or electronic circuits operating in parallel and/or operating on different parts of the complete processing.

The instructions for operating the processor or the processors according to the described processing can be stored in one or more memories. The at least one processor is configured to carry out these instructions.

The invention claimed is:

1. A method for using a smartphone equipped with at least two microphones ($m_1$,$m_2$) for determining the direction of loudspeakers A, in a setup of a surround sound system including N loudspeakers, k=1 . . . N, wherein said direction is expressed by an azimuth angle $\phi_k$ and a polar angle $\theta_k$, said method including:

a) setting initial values ($\phi_0$,$\theta_0$) for said azimuth angle $\phi_k$ and said polar angle $\theta_k$ for loudspeaker $l_k$ direction;

b) in a first loop over smartphone position angle $\alpha$ for the determination of one of $\phi_k$ and $\theta_k$, and thereafter in a second loop over smartphone position angle $\alpha$ for the determination of the other one of $\phi_k$ and $\theta_k$:

c) setting k=1;

d) in a sub-loop over k:

e) in a sub-sub-loop over a rotation angle of said smartphone:

f) causing loudspeaker $l_k$ to emit a test signal ($s_k(t)$);

g) rotating said smartphone and providing for said smartphone a corresponding measured smartphone rotation angle value $\alpha_k$, h) capturing corresponding smartphone microphone signals ($y_{k1}(t)$, $y_{k2}(t)$) from said loudspeaker $l_k$ test signal;

i) calculating from said microphone signals a corresponding Time Difference of Arrival value ($\tau_k(\alpha_k)$);

j) if said Time Difference of Arrival value ($\tau_k(\alpha_k)$) is not zero or is not smaller than a predetermined threshold value, returning to step f);

k) otherwise, calculating a corresponding azimuth $\phi_k$ or polar $\theta_k$, respectively, angle value for the position of loudspeaker $l_k$;

L) incrementing k by '1';

m) if k≤N, returning to step f);

n) otherwise, checking whether both of $\phi_k$ and $\theta_k$ have been determined, and if not true, returning to step b);

o) after all positions of said N loudspeakers have been determined, providing a corresponding set of N pairs of azimuth and polar angle values $\phi_k$ and $\theta_k$ for said loudspeakers $l_k$ and for all k;

p) using said corresponding set of pairs of azimuth and polar angle values to accurately calibrate said loudspeakers $l_k$.

2. The method for using a smartphone equipped with at least two microphones ($m_1$,$m_2$), having a known distance ($d_{12}$) from each other, for determining the direction of loudspeakers $l_k$ in a setup of a surround sound system including N loudspeakers, k=1 . . . N, wherein said direction is expressed by an azimuth angle $\phi_k$ and a polar angle $\theta_k$, said method including:

a) setting initial values ($\phi_0$,$\theta_0$) for said azimuth angle $\phi_k$ and said polar angle $\theta_k$ for loudspeaker $l_k$ direction;

b) in a first loop over smartphone position angle $\alpha$ for the determination of one of $\phi_k$ and $\theta_k$, and thereafter in a second loop over smartphone position angle $\alpha$ for the determination of the other one of $\phi_k$ and $\theta_k$:

c) positioning said smartphone at a desired azimuth angle or polar angle;

d) setting k=1;

e) in a sub-loop over k:

f) causing loudspeaker $l_k$ to emit a test signal ($s_k(t)$);

g) capturing the smartphone microphone signals ($y_{k1}(t)$, $y_{k2}(t)$) from said loudspeaker $l_k$ test signal;

h) determining from said captured smartphone microphone signals ($y_{k1}(t)$, $y_{k2}(t)$) a loudspeaker distance difference value ($\Delta_k$) and calculating a corresponding smartphone position angle value ($\alpha_k$):

i) calculating a corresponding azimuth $\phi_k$ or polar $\theta_k$, respectively, angle value for the position of loudspeaker $l_k$;

j) incrementing k by '1';

k) if k≤N, returning to step f);

l) otherwise, checking whether both of $\phi_k$ and $\theta_k$, have been determined, and if not true, returning to step b);

m) after all positions of said N loudspeakers have been determined, providing a corresponding set of N pairs of azimuth and polar angle values $\phi_k$ and $\theta_k$ for said loudspeakers $l_k$ and for all k;

n) using said corresponding set of pairs of azimuth and polar angle values to accurately calibrate said loudspeakers $l_k$.

3. The method according to claim 2, wherein for determining the distance ($d_{12}$) between said two microphones ($m_1$, $m_2$) the following processing is carried out:

a) selecting one loudspeaker $l_k$ of said N loudspeakers;

b) causing loudspeaker $l_k$ to emit a test signal ($s_k(t)$);

c) capturing the smartphone microphone signals ($y_{k1}(t)$, $y_{k2}(t)$) from said loudspeaker $l_k$ test signal;

d) rotating said smartphone and providing for said smartphone a corresponding measured smartphone rotation angle value $\alpha_k$;

e) calculating a corresponding Time Difference of Arrival value ($\tau_k(\alpha_k)$);

f) if said Time Difference of Arrival value ($\tau_k(\alpha_k)$) is not zero or is not smaller than a predetermined threshold value, returning to step b);

g) otherwise, defining an initial direction angle value $\beta=0$;

h) rotating said smartphone by an angle $\beta\approx\pi/4$ and providing for said smartphone a corresponding measured rotation angle value $\beta$;

i) causing loudspeaker $l_k$ to emit a test signal ($s_k(t)$);

j) capturing the smartphone microphone signals ($y_{k1}(t)$, $y_{k2}(t)$) from said loudspeaker $l_k$ test signal;

k) calculating from said smartphone microphone signals ($y_{k1}(t)$,$y_{k2}(t)$) a loudspeaker distance difference value $\Delta_k$ and a microphone distance value $$d_{12} = \frac{\Delta_k}{\sin\beta}.$$

4. The method according to claim 1, wherein said smartphone includes an app that controls the processing.

5. The method according to claim 2, wherein smartphone includes an app that controls the processing.

6. The method according to claim 1, wherein said smartphone microphone signals are $$y_{k1}(t)=g(d_{k1})s_k(t-\Delta T_{k1})+n_1(t) \text{ and}$$

$$y_{k2}(t)=g(d_{k2})s_k(t-\Delta T_{k2})+n_2(t),$$

wherein $\Delta T_{k1}$ is the time the sound wave needs for propagating from loudspeaker $l_k$ to microphone $m_1$ and $\Delta T_{k2}$ is the time the sound wave needs for propagating from loudspeaker $l_k$ to microphone $m_2$, $S_k(\circ)$ is said test signal, $g(d_{k\circ})$ is an attenuation factor which describes the dependence of the amplitude on the distance $d_{k\circ}$ between loudspeaker $l_k$ and microphone $m_1$ or $m_2$, and $n_1(t)$ and $n_2(t)$ take into account environmental and internal noise of said microphones.

7. The method according to claim 2, wherein said smartphone microphone signals are $$y_{k1}(t)=g(d_{k1})s_k(t-\Delta T_{k1})+n_1(t) \text{ and}$$

$$y_{k2}(t)=g(d_{k2})s_k(t-\Delta T_{k2})+n_2(t),$$

wherein $\Delta T_{k1}$ is the time the sound wave needs for propagating from loudspeaker $l_k$ to microphone $m_1$ and $\Delta T_{k2}$ is the time the sound wave needs for propagating from loudspeaker $l_k$ to microphone $m_2$, $S_k(\circ)$ is said test signal, $g(d_{k\circ})$ is an attenuation factor which describes the dependence of the amplitude on the distance $d_{k\circ}$ between loudspeaker $l_k$ and microphone $m_1$ or $m_2$, and $n_1(t)$ and $n_2(t)$ take into account environmental and internal noise of said microphones.

8. The method according to claim 6, wherein said Time Difference of Arrival for loudspeaker $l_k$ for said smartphone microphones is defined as $\tau_k=\Delta T_{k1}-\tau_{k2}$, which corresponds to the spatial difference $\Delta_k=|d_{k1}-d_{k2}|=c|\tau_k|$ between said smartphone microphones and said loudspeaker $l_k$ with the sound velocity c in air as a scaling factor.

9. The method according to claim 3, wherein said Time Difference of Arrival for loudspeaker $l_k$ for said smartphone microphones is defined as $\tau_k=\Delta T_{k1}-\tau_{k2}$, which corresponds to the spatial difference $\Delta_k=|d_{k1}-d_{k2}|=c|\tau_k|$ between said smartphone microphones and said loudspeaker $l_k$ with the sound velocity c in air as a scaling factor.

10. The method according to claim 1, wherein said Time Difference of Arrival is estimated by using a cross-correlation function $$R_k(\tau)=\mathbb{E}\{y_{k1}(t)y_{k2}(t-\tau)\}=\int_{-\infty}^{+\infty} Y_{k1}(f)Y_{k2}^*(f)\exp^{2\pi i f\tau}df$$

with $y_{k(1|2)}(t)$ being the signals captured by said smartphone microphones and $y_k(1l_2)(f)$ being their respective Fourier transforms, and wherein the time delay between the microphone signals is obtained by searching the peak in the correlation $$\tau_k = \underset{\tau}{\operatorname{argmax}} R_k(\tau).$$

11. The method according to claim 3, wherein said Time Difference of Arrival is estimated by using a cross-correlation function $$R_k(\tau)=\mathbb{E}\{y_{k1}(t)y_{k2}(t-\tau)\}=\int_{-\infty}^{+\infty} Y_{k1}(f)Y_{k2}^*(f)\exp^{2\pi i f\tau}df$$

with $y_{k(1|2)}(t)$ being the signals captured by said smartphone microphones and $y_{k(1|2)}(f)$ being their respective Fourier transforms, and wherein the time delay between the microphone signals is obtained by searching the peak in the correlation $$\tau_k = \underset{\tau}{\operatorname{argmax}} R_k(\tau).$$

12. The method according to claim 1, wherein, instead of interactive rotation of said smartphone with respect to each loudspeaker for direction determination, it is assumed that the distances $d_{k1}$, $d_{k2}$ between the microphones of said smartphone and said loudspeaker are much greater than the distance $d_{12}$ between the microphones in said smartphone, and the angle $\alpha_k$ between the line between both microphones and the direction of said loudspeaker is $$\alpha_k = \arcsin\left(\frac{\Delta_k}{d_{12}}\right),$$

k=1, . . . , N, and wherein, in order to avoid the ambiguity about in which half space a loudspeaker is located, two successive measurements are conducted and in the second measurement said smartphone is rotated by approximately 90° and the determination of the sign of said time delay $\tau_k$ is used for fixing the direction of said loudspeaker.

13. A computer program product stored on a non-transitory computer readable medium comprising instructions which, when carried out on a mobile device, perform the method according to claim 1.

14. A computer program product stored on a non-transitory computer readable medium comprising instructions which, when carried out on a mobile device, perform the method according to claim 2.

15. A measurement device for determining the direction of loudspeakers $l_k$ in a setup of a surround sound system including N loudspeakers, k=1 . . . N, adapted to cooperate with a smartphone equipped with at least two microphones ($m_1$,$m_2$), wherein said direction is expressed by an azimuth angle $\phi_k$ and a polar angle $\theta_k$, said smartphone comprising at least one processor configured for:

a) setting initial values ($\phi_0$,$\theta_0$) for said azimuth angle $\phi_k$ and said polar angle $\theta_k$ for loudspeaker $l_k$ direction;
b) in a first loop over smartphone position angle $\alpha$ for the determination of one of $\phi_k$ and $\theta_k$, and thereafter in a second loop over mobile device position angle $\alpha$ for the determination of the other one of $\phi_k$ and $\theta_k$:
c) setting k=1;
d) in a sub-loop over k:
e) in a sub-sub-loop over a rotation angle of said smartphone;
f) receiving for said smartphone being rotated a corresponding measured smartphone rotation angle value $\alpha_k$;
g) receiving corresponding smartphone microphone signals ($y_{k1}(t)$, $y_{k2}(t)$) from emitted loudspeaker $l_k$ test signal;
h) calculating from said microphone signals a corresponding Time Difference of Arrival value ($\tau_k(\alpha_k)$);
i) if said Time Difference of Arrival value ($\tau_k(\alpha_k)$) is not zero or is not smaller than a predetermined threshold value, returning to step f);
j) otherwise, calculating a corresponding azimuth $\phi_k$ or polar $\theta_k$, respectively, angle value for the position of loudspeaker $l_k$;
k) incrementing k by '1';
l) if k≤N, returning to step f);
m) otherwise, checking whether both of $\phi_k$ and $\theta_k$ have been determined, and if not true, returning to step b);
n) after all positions of said N loudspeakers have been determined, providing a corresponding set of N pairs of azimuth and polar angle values $\phi_k$ and $\theta_k$ for said loudspeakers $l_k$ and for all k;
o) using said corresponding set of pairs of azimuth and polar angle values to accurately calibrate said loudspeakers $l_k$.

16. A measurement device for determining the direction of loudspeakers $l_k$ in a setup of a surround sound system including N loudspeakers, k=1 . . . N, adapted to cooperate with a smartphone equipped with at least two microphones ($m_1$,$m_2$), wherein said direction is expressed by an azimuth angle $\phi_k$ and a polar angle $\theta_k$, said smartphone comprising at least one processor configured for:

a) setting initial values ($\phi_0$,$\theta_0$) for said azimuth angle $\phi_k$ and said polar angle $\theta_k$ for loudspeaker $l_k$ direction;
b) in a first loop over position angle $\alpha$ for the determination of one of $\phi_k$ and $\theta_k$, and thereafter in a second loop over smartphone position angle $\alpha$ for the determination of the other one of $\phi_k$ and $\theta_k$, said smartphone having a desired azimuth angle or polar angle:
c) setting k=1;
d) in a sub-loop over k:
e) receiving smartphone microphone signals ($y_{k1}(t)$, $y_{k2}(t)$) from emitted loudspeaker $l_k$ test signal ($s_k(t)$);
f) determining from said captured smartphone microphone signals ($y_{k1}(f)$, $y_{k2}(t)$) a loudspeaker distance difference value ($\Delta_k$) and calculating a corresponding smartphone position angle value ($\alpha_k$);
g) calculating a corresponding azimuth $\phi_k$ or polar $\theta_k$, respectively, angle value for the position of loudspeaker $l_k$;
h) incrementing k by '1';
i) if k≤N, returning to step e);
j) otherwise, checking whether both of $\phi_k$ and $\theta_k$ have been determined, and if not true, returning to step b);
k) after all positions of said N loudspeakers have been determined, providing a corresponding set of N pairs of azimuth and polar angle values $\phi_k$ and $\theta_k$ for said loudspeakers $l_k$ and for all k;
l) using said corresponding set of pairs of azimuth and polar angle values to accurately calibrate said loudspeakers $l_k$.

17. The measurement device of claim 16, in which said at least one processor is further configured for:

a) capturing smartphone microphone signals ($y_{k1}(t)$, $y_{k2}(t)$) from loudspeaker $l_k$ test signal emitted by a selected loudspeaker $l_k$ among said N loudspeakers;
b) receiving for said smartphone a measured smartphone rotation angle value $\alpha_k$ corresponding to a rotation of said smartphone;
c) calculating a corresponding Time Difference of Arrival value ($\tau_k(\alpha_k)$);
d) if said Time Difference of Arrival value ($\tau_k(\alpha_k)$) is not zero or is not smaller than a predetermined threshold value, returning to step a);
e) otherwise, defining an initial direction angle value $\beta=0$;
f) receiving for said smartphone a measured rotation angle value $\beta$ corresponding to rotating said smartphone by an angle $\beta\approx\pi/4$;
g) receiving smartphone microphone signals from emitted loudspeaker $l_k$ test signal;
h) calculating from said smartphone microphone signals a loudspeaker distance difference value $\Delta_k$ and a microphone distance value $$d_{12} = \frac{\Delta_k}{\sin\beta}.$$

* * * * *